United States Patent [19]

Griffith

[11] 4,193,535

[45] Mar. 18, 1980

[54] BULK MATERIALS CONTAINER FORMED FROM SUBSTANTIALLY RECTANGULAR BLANK

[75] Inventor: Harold J. Griffith, Galesburg, Ill.

[73] Assignee: Alton Box Board Company, Alton, Ill.

[21] Appl. No.: 942,926

[22] Filed: Sep. 18, 1978

[51] Int. Cl.[2] ..... B65D 5/10; B65D 5/46

[52] U.S. Cl. ..... 229/52 B

[58] Field of Search ..... 229/52 B, 52 BC

[56] References Cited

U.S. PATENT DOCUMENTS

| | | | |
|---|---|---|---|
| 2,306,343 | 12/1942 | Neubecker et al. | 229/52 B |
| 2,889,104 | 6/1959 | Caster et al. | 229/52 B |
| 2,901,159 | 8/1959 | Talbot, Jr. | 229/52 B X |
| 2,933,232 | 4/1960 | Bugnone | 229/52 B X |
| 3,815,809 | 6/1974 | Walters | 229/52 B X |
| 3,860,113 | 1/1975 | Helms | 229/52 BC X |
| 4,017,017 | 4/1977 | Vos | 229/52 B X |

*Primary Examiner*—Davis T. Moorhead

*Attorney, Agent, or Firm*—Paul M. Denk

[57] ABSTRACT

In a container for holding bulk materials or the like, and formed from a blank of paperboard stock, it incorporates front, side, and rear walls of substantially equal size, a bottom wall formed of various bottom flaps providing closure at its lower segment, and a cover for the container formed from a series of top flaps that foldably connect to the upper edges of the aforementioned walls. The cover is provided with an upstanding handle to facilitate the conveyance of the container, and this handle is formed from a pair of hand panels that foldably connect with certain of the top flaps, with each hand panel formed from a pair of handle flaps, one flap of which foldably connects with the top flaps securing with the front and rear walls, while the second handle flap foldably connects along a side edge with the side edge of the first mentioned handle flap, and when these handle flaps are folded over into adjacency, they are formed having aligned slots to facilitate the entrance of the hand during container usage.

4 Claims, 6 Drawing Figures

BULK MATERIALS CONTAINER FORMED FROM SUBSTANTIALLY RECTANGULAR BLANK

BACKGROUND OF THE INVENTION

The invention relates generally to containers, and more particularly relates to a specific type of bulk materials handling container that is formed from a unitary sheet of paperboard material, and folded in a manner that facilitates both the retention of a container in closure and its conveyance during usage.

A variety of prior art paperboard material containers have been available in the trade, and are generally formed for specific purposes for accommodating particular items. For example, the suit box disclosed in the Osborn U.S. Pat. No. 1,501,134, discloses a blank formed box having double reinforced handle means at its upper end, but as can be seen from this patent, the blank is of substantially irregular configuration, and its handle is formed from double flaps that extend further outwardly, rather than into adjacency, with the box in its blank formed. U.S. Pat. No. 1,856,729, to Robinson, discloses a double handle reinforced fiber shipping case wherein the handles are formed of double flaps that are hingedly connected along their width dimension, rather than at their side edges thereof.

The various prior art patents to Leone, U.S. Pat. No. 2,900,124, Kuchenbecker, No. 3,172,594, Nock, No. 3,776,108, and Gatward, No. 2,916,195, disclose variations upon the formation of handle means for various style of cartons, but as can be seen from these patents, the reinforcement for the handle means involves little consideration in the use of materials from its blank form, generally necessitating the cutting of a blank to highly irregular shapes to attain its particular styled folded carton.

In view of the foregoing, it is the principal object of this invention to provide a container formed from a unitary blank and which is substantially rectangular in configuration thereby easing the fabrication of this container from the blank form, while minimizing substantially any waste material in cutting of such blank from larger sheets of paperboard stock.

Another object of this invention is to provide a quadruply reinforced upper handle for a container for bulk materials, and wherein the handle may be secured together in a semilockable position to insure its closure during conveyance, but likewise is facily manipulated into opening during usage.

A further object of this invention is to provide the fabrication of a quadruply reinforced handle for a bulk materials container and wherein the various flaps forming the handle are substantially aligned laterally within the carton blank before its folding into closure.

Another object of this invention is to provide a substantially rectangular blank for a bulk materials container which can be easily transferred and shipped due to its compactness in configuration.

Another object of this invention is to provide a bulk materials container that can be easily folded by either machinery or manually for prompt usage.

Other objects will become more apparent to those skilled in the art upon reviewing the details of this disclosure, and particularly upon analyzing the description of the preferred embodiment in view of its drawings.

SUMMARY OF THE INVENTION

In a container for holding bulk materials, such as candy or the like, the container is folded from a unitary sheet of substantially rectangular configured paperboard material, and is incorporated having a front, side, rear, and side wall foldably connected together in that order, and with each of said walls having a bottom flap connected therewith, as along their lower edges, and which also may be folded into closure so as to furnish the bottom for the container during usage.

The cover means for this container is formed from a series of top flaps, one of each being foldably connected with the upper edges of the said front, side, and rear walls, with those flaps connecting with the front and rear walls having hand panels connected therewith and which can be conveniently folded into useable configuration simultaneously with the folding of the blank into the container form. These handle panels are each formed having a pair of handle flaps, with one flap of each pair comprising that portion of the hand panel foldably connecting with its respective top flap, while the second hand flap of each pair is foldably connected along its side edge with the side edge of the laterally adjacent first handle flap. Thus, in the folded configuration, both of the handle flaps of each pair are folded into adjacency, contiguously with each other, and each are formed having a slot provided centrally therethrough so that when the pair of hand panels are brought into registry above the top of the container as its cover means is folded into closure, the hand slots formed through each flap will become in registry so as to furnish a quadruply reinforced handle for the carrying container, that not only insures adequate structural reinforcement for the conveyed container, but likewise, is provided with means for locking the same together for the convenience of maintaining container closure during usage, or even during nonusage.

The locking means is furnished through the agency of the positioning of at least one of the cut out portions from a formed hand slot being yet hingedly connected to an edge of the slot formed in at least one of the handle flaps, with that particular cut out portion then being bent through all of the aligned hand slots of the pair of hand panels when the cover means is folded into closure.

DESCRIPTION OF THE PREFERRED EMBODIMENT

Figure 1:
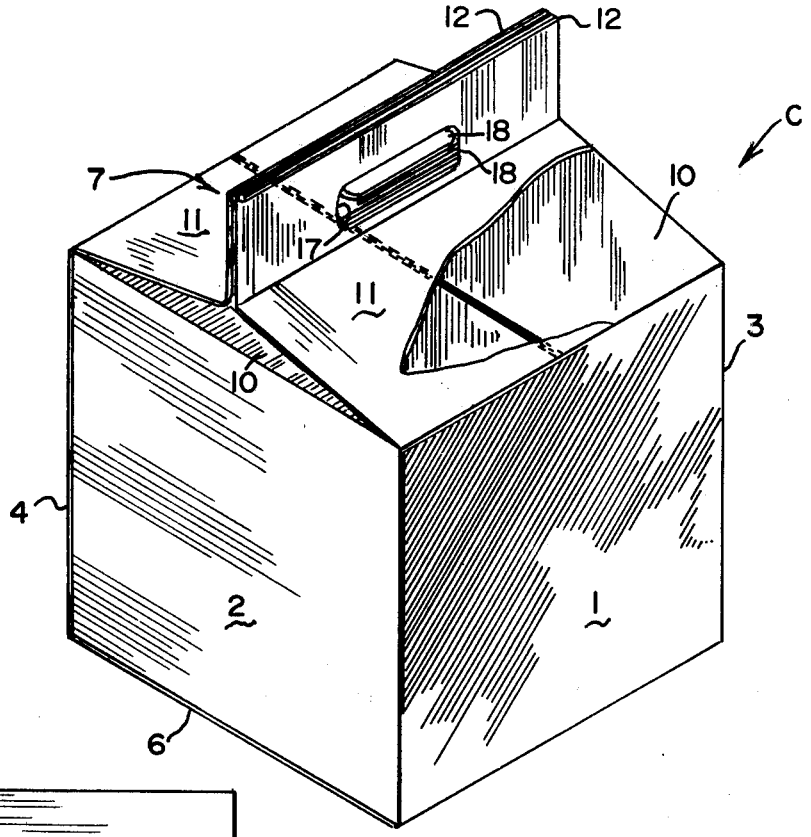
FIG. 1 provides an isometric view of the container of this invention.
Figure 2:
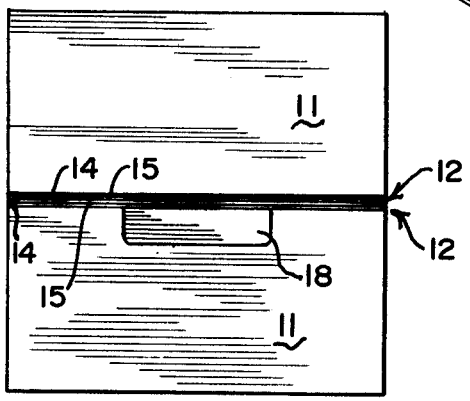
FIG. 2 furnishes a top plan view of the container shown in FIG. 1.
Figure 6:
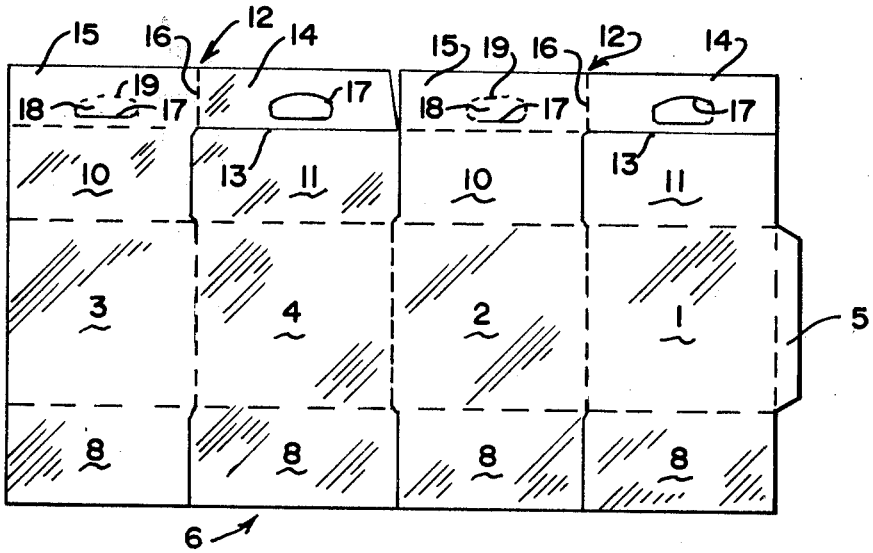
FIG. 6 furnishes a view of the blank used for forming the container of FIG. 1.

In referring to the drawings, and in particular FIG. 1, there is disclosed the container C of this invention, which is formed having a front wall 1, side walls 2 and 3, and a rear wall 4, all being held together by means of a glue flap, as provided at 5 in FIG. 6, to form a generally cube like configuration for holding bulk materials. A bottom wall 6 furnishes closure at this lower location, while a cover means 7 furnishes temporary closure at the upper reaches of said container.

Figure 3:
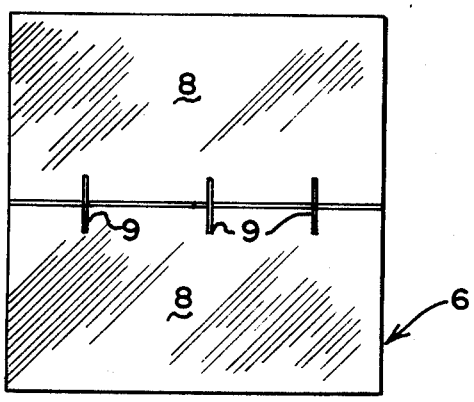
FIG. 3 provides a bottom view of the container of FIG. 1.
Figure 4:
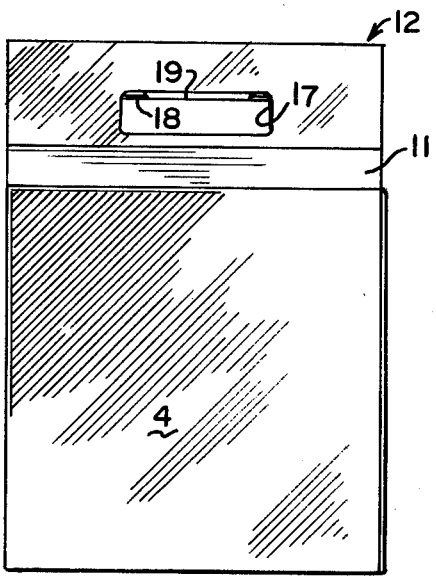
FIG. 4 provides a left side view of the container as shown in FIG. 1.

As can be further seen from the blank disclosed in FIG. 6, the bottom wall 6 is actually formed from a series of bottom flaps, as at 8, one of each which is foldably connected to the lower edge of the aforementioned front, side, and rear walls. These flaps are then folded over and then rigidly fastened together, as by means of the staples 9, as shown in FIG. 3.

Figure 5:
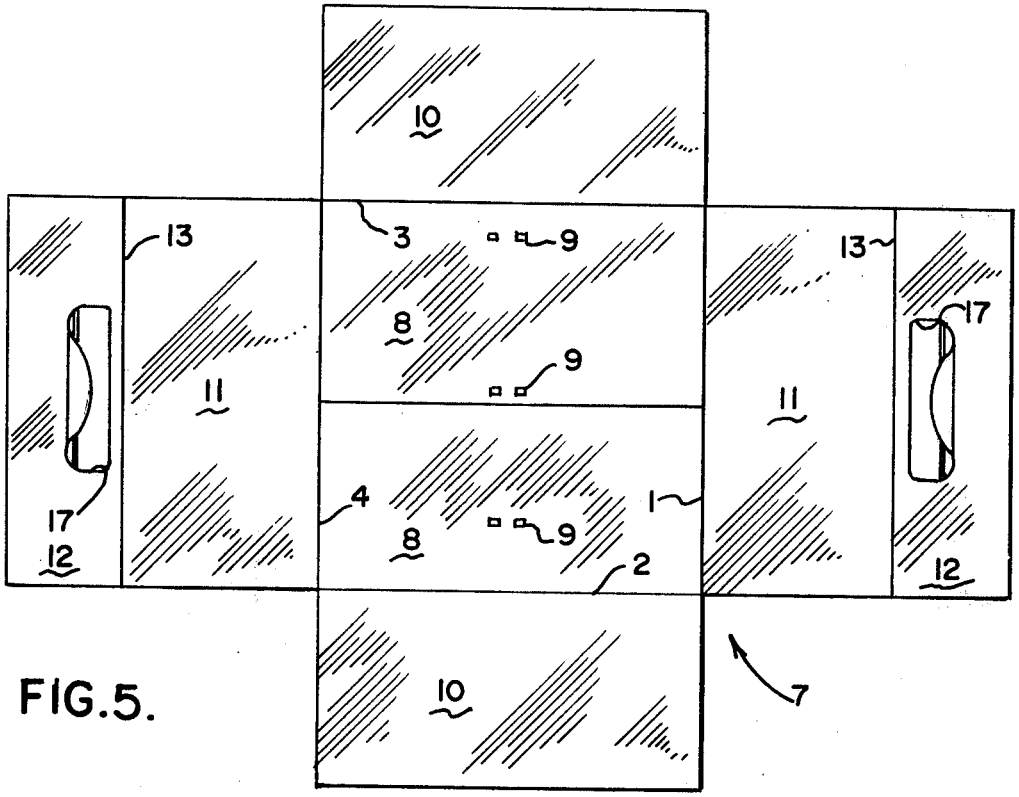
FIG. 5 discloses the top plan view of the container of FIG. 1, with its various top flaps and handle panels of the cover means being radially disposed open so as to show the interior of the container.

As can also be seen from FIG. 5, the cover means 7 is likewise formed from a series of flaps, with a first pair of flaps 10 being foldably connected to the side walls 2 and 3, respectively, and which flaps are folded over initially to provide coverage for any of the bulk materials, such as candy, that may be stored therein. A second pair of flaps 11 are respectively foldably connected with the front walls 1 and 4, and which flaps likewise may be folded over into overlying relationship with the aforementioned pair of flaps 10, so as to provide further coverage in the upper reaches of this container, as when it is being conveyed.

Connecting to the opposite side edges of the pair of flaps, 11, said connection being made substantially along the entire width of said flaps, are the hand panels 12, said foldable connection being made along the fold lines, as at 13. By referring once again to FIG. 6, it can be seen that each hand panel 12 is formed from a pair of handle flaps 14 and 15, respectively, with each of the handle flaps 14 being foldably connected, as previously explained, along the fold line 13 to their respective flaps 11. Each of the handle flaps 15 is foldably connected, as along the fold lines 16, to the handle flaps 14, and in the folded configuration, as when the container is formed, these flaps 15 are folded over approximately 180° into overlying relationship with the flaps 14, to therein provide double reinforcement for each of the hand panels 12 associated with each flap 11 of the container. And, each of the flaps 14 and 15 have a slot 17 cut therethrough, so that when the various flaps 14 and 15 are manipulated into overlying relationship, the slots 17 enter into registry, and thereby provide aligned clearance for insertion of the hand through the hand panels 12 during container conveyance. In addition, the slots 17 associated with each of the handle flaps 15 yet include their cut out portions 18 still hingedly connected, as along the fold lines 19, within the positions of the hand slots, and these cut out portions are free for bending over into engaging relationship as when the handle panels 12 are brought into contiguity over the top of the container when its cover means is closed, in the manner as shown in FIG. 1. Thus, the cut out portions 18 can be seen being bent through the hand slot 17 in this FIG. 1, and thereby providing means for temporarily securing the handle panels 12 together during container closure, while at the same time providing a greater surface for gripping of the hand panels by the user of the container.

It is to be noted from the blank shown in FIG. 6 that the container is designed being substantially cubical in configuration, since the front, rear, and side walls are generally square in configuration, but obviously other shapes for the container may be made depending upon the dimensions of these walls in the blank form. It is to be also noted from the FIG. 6 that the entire carton blank, with the exception of its glue flap 5, forms a generally rectangular configuration, thereby utilizing all available board feet of the paperboard material, with little or no waste being encountered. Furthermore, in the folded configuration for the container, as can be seen from FIG. 1, its cover means can be quickly and promptly folded into closure, providing a quadruply reinforced handle that insures no tearing of the container at this location, but at the same time, the handle panels 12 can be easily separated from each other, to provide immediate opening and access into the upper reaches of the container for dispensing of its bulk material contained therein. In addition, since each hand panel 12 is formed from a pair of handle flaps 14 and 15, which are arranged laterally adjacent but foldably connected together, and such not only provides for a double reinforcement of each handle panel, and at the same time providing for quadruple reinforcement for the entire handle of the coverings, but the lateral design of these handle flaps in the blank form as shown in the manner of FIG. 6 provides the means for conserving of paperboard material in the cutting of this container blank, since in that design the entire blank undertakes the rather compactly rectangular shape exhibiting little or no necessity for dispensing with any waste materials after a blank cut.

Variations in the design and formation of the container, and its blank, of this invention may occur to those skilled in the art upon reviewing the subject matter of this invention. The description set forth within this application is provided for illustrative purposes only, and is not meant to be limiting to the scope of the invention herein. Any such variations made to the structure of this container, and within the spirit of the invention herein defined are intended to be embodied in and protected by the scope of the claims appended hereto.

Having thus described the invention what is claimed and desired to be secured by Letters Patent is:

1. An enclosed container for holding bulk materials, such as candy or the like, and being formed from a blank that is substantially rectangular in dimensions, comprising, said container being folded from paperboard stock and formed having front, side, rear walls, and a bottom wall, all of said front, side, and rear walls being connected together along their sides with the bottom wall securing along their downward edges to provide a container formed from a substantially rectangular blank, and openable cover means for the container that insures the carrying capabilities and its prompt opening during usage, said cover means including a first pair of flaps, one flap foldably connected to the upper edge of one of each side wall and normally folded over into closure, a second pair of flaps, one of each second flap foldably connected to the upper edge of said front and rear walls and normally folded over into closure and in overlying relationship with the said first pair of flaps, hand panels foldably connecting to each of the second pair of flaps, each hand panel comprising a pair of handle flaps, one of each handle flaps connecting to the upper edge of a flap of the said second pair of flaps substantially along its entire width, the other handle flap being arranged above one of the first pair of flaps and having a width substantially equivalent thereto, said other handle flap being connected upon a side edge thereof to the side edge of the first handle flap and being folded over into contiguity therewith to form a doubly reinforced hand panel, therebeing hand slots formed through each handle flap and with said slots being in registry, and each hand panel being folded over into adjacency in the formed container with the respective hand slots being aligned to accommodate the facile insertion of the hand therethrough.

2. The invention of claim 1 and including a cut out portion of at least one formed hand slot of a hand panel being hingedly connected to the edge of said slot formed in one handle flap and being bent through the aligned hand slots to insure retention of the hand panels together during container conveyance.

3. The container of claim 1 and wherein the front, side, and rear walls are of substantially equal size.

4. A blank for a container useful for holding bulk materials, such as candy or the like, said blank being of substantially rectangular configuration, void of any substantially projecting parts, and cut from a singular sheet of paperboard stock, a series of side, rear, side, and front walls being foldably connected in that order to each other along side edges thereof, a glue flap provided along the other free edge of one of said walls and provided for attachment to the approximate side edge of another wall when the container is folded into its usable configuration, bottom flaps foldably connected to the lower edge of each side, rear, and front walls for forming a bottom wall for the container when folded, top flaps foldably connected to the upper edges of each of said side, rear, and front walls and useful for forming a cover for the container when folded, hand panels foldably connected to the upper edges of the top flap connecting with the front and rear walls, each hand panel in the blank being formed of a pair of adjacent handle flaps, said hand panels being accumulatively coextensive in width with the combined width of the said side, front and rear walls, one of said handle flaps connecting to the upper edge of the top flaps connecting respectively with the front and rear walls, the other handle flap of each hand panel being connected along a side edge thereof to the side edge of the first handle flap and being arranged substantially above the top flap connecting with the said side walls, and the hand slots being cut through each handle flap to provide a unitary hand slot for the container when folded into its usable configuration.

* * * * *